US005887834A

United States Patent [19]

Gellos et al.

[11] Patent Number: 5,887,834

[45] Date of Patent: Mar. 30, 1999

[54] CONTAINER SECUREMENT APPARATUS

[76] Inventors: Todd A. Gellos, 3425 SE. Steele, Portland, Oreg. 97202; Kenneth R. Walker, 3441 NE. 32$^{nd}$ Pl., Portland, Oreg. 97212

[21] Appl. No.: 813,353

[22] Filed: Mar. 7, 1997

[51] Int. Cl.$^{6}$ ..... A45F 3/44

[52] U.S. Cl. ..... 248/156; 248/157; 248/907

[58] Field of Search ..... 248/146, 156, 248/907, 218.4, 149, 507, 157, 530, 534, 535, 423, 219.2, 314, 508

[56] References Cited

U.S. PATENT DOCUMENTS

| | | | |
|---|---|---|---|
| 1,837,411 | 12/1931 | Cutter | 248/907 |
| 2,448,456 | 8/1948 | Niskanen | 248/907 |
| 2,552,745 | 5/1951 | Stanley | 248/156 |
| 2,644,460 | 7/1953 | Miller | 248/156 |
| 2,701,700 | 2/1955 | Williamson | 248/156 |
| 2,745,676 | 5/1956 | Scott | 248/907 |
| 2,802,673 | 8/1957 | Hazlett | 248/907 |
| 2,865,590 | 12/1958 | Greenwell | 248/361 |
| 2,929,512 | 3/1960 | McDougle | 248/907 |
| 3,102,707 | 9/1963 | Jacklin | 248/146 |
| 4,072,286 | 2/1978 | Foncannon | 248/154 |
| 4,135,725 | 1/1979 | DiRoma | 248/129 |
| 4,319,726 | 3/1982 | Andersson | 248/97 |
| 4,483,506 | 11/1984 | Litwiller | 248/545 |
| 4,520,985 | 6/1985 | Blumenthal | 248/156 |
| 4,753,411 | 6/1988 | Lechner | 248/533 |
| 4,905,945 | 3/1990 | Peterson | 248/146 |
| 4,940,201 | 7/1990 | Kurth | 248/156 |
| 5,033,703 | 7/1991 | Allen, Sr. | 248/97 |
| 5,065,975 | 11/1991 | Giles | 248/545 |
| 5,123,623 | 6/1992 | McNamara | 248/545 |
| 5,139,219 | 8/1992 | Navarro | 248/97 |
| 5,163,577 | 11/1992 | Lee | 220/318 |

*Primary Examiner*—Leslie A. Braun
*Assistant Examiner*—Gwendolyn Baxter
*Attorney, Agent, or Firm*—Kolisch, Hartwell, Dickinson, McCormack & Heuser

[57] ABSTRACT

The present invention provides an apparatus to minimize lateral tipping of refuse containers by winds, animals and the like. A securement apparatus for wheel-based or conventional refuse containers is described. The invented apparatus includes an elongate stake having a hooked bracket and a tethering means which releasably captures a handle and a lid respectively of a refuse container. A tapered end and support surface penetration stop member on the elongate stake facilitate partial, vertical penetration of a support surface by the stake. When the stake is vertically penetrating the support surface, the hooked bracket may be adjusted to secure handles of various size, shape, and capacity refuse containers.

3 Claims, 2 Drawing Sheets

CONTAINER SECUREMENT APPARATUS

TECHNICAL FIELD

The invention generally relates to refuse containers, more specifically, to a securement apparatus for wheel-based containers or containers with handles used in collecting trash and yard debris.

BACKGROUND ART

Inadvertent spillage of refuse containers' contents has been a long-standing problem. One of the main benefits of wheel-based refuse containers is the ease by which it is moved curbside for pick up by refuse collectors. One of the drawbacks of wheel-based containers is that they are easily tipped over because the wheel-base is designed to be tipped back easily for wheeling the container to and from the curbside.

Expensive encasements of wood or other material may be built around the container to prevent spillage. However, often these encasements must be built at a location that is not visible from the street or at other off-street locations dictated by community regulations. Therefore, when the container is to be placed curb-side for collection of its contents, the container is removed from the encasement and is still subject to tipping over by animals or winds whereby the contents are spilled instead of being collected.

Conventional circular containers may be placed in a device which immobilizes the base of the container in order to minimize lateral displacement and spillage of the contents. Such base-retaining devices are described in U.S. Pat. Nos. 4,072,286, 3,471,114, 4,072,286 and 4,905,945. While all of these patents provide devices that will immobilize the base of a circular refuse container, a wheel-based container or a lid could not be immobilized by any of these devices. In addition, these patents do not describe a device that facilitates easy securement of the container without lifting of the container, which may be difficult or impossible when it is full of refuse. Importantly, these devices do not interchangeably fit circular and wheel-based containers of various capacities. Another problem with these devices is that they are a hazard, if left in place at curbside, because of their permanence and low visibility due to their minimal elevation from the ground.

A principal object of the present invention is to provide a securement apparatus for a refuse container and its lid that stabilizes the container against forces, such as animals or winds, that might tip over the container and spill its contents.

Another important object of the invention is to provide versatility of securement with various sized and shaped containers including wheel-based containers.

A further object of the invention is to provide a securement apparatus that facilitates use of the apparatus especially when the container is full.

Yet another object of the invention is to quickly and easily secure a container without impeding or interfering with collection of its contents.

Finally, it is an object of the invention to provide a securement apparatus that is lightweight, portable, easy-to-use and inexpensive to manufacture.

SUMMARY OF THE INVENTION

Briefly, the invention secures refuse containers and their lids. In the preferred embodiment of the invention, the securement apparatus includes an elongate stake made of metal or equally durable, rigid material configured to vertically and partially penetrate a support surface, such as the ground. Attached to the stake is a height-adjustable hooked bracket dimensioned to releasably capture the handle of a wheel-based or conventional refuse container of any capacity.

The apparatus also includes a tethering means such as braided steel hemp, or plastic rope, attached to a looped fastener, e.g. an eye- or U-bolt, on the stake. This tethering means, in turn, attaches to the lid handle of conventional refuse containers or may be looped under a wheel-based container, then over its lid, whereby the lid is secured.

The present invention provides a portable, lightweight, easy-to-use and convenient apparatus which provides for lateral securement of refuse containers against animals and winds tipping over the containers and thereby spilling the contents. The apparatus may be used interchangeably for wheel-based or conventional refuse containers. Even when filled with heavy refuse, the container is easily secured by tipping the container so that the handle slips over the bracket.

DETAILED DESCRIPTION OF THE PREFERRED EMBODIMENT

Figure 1:
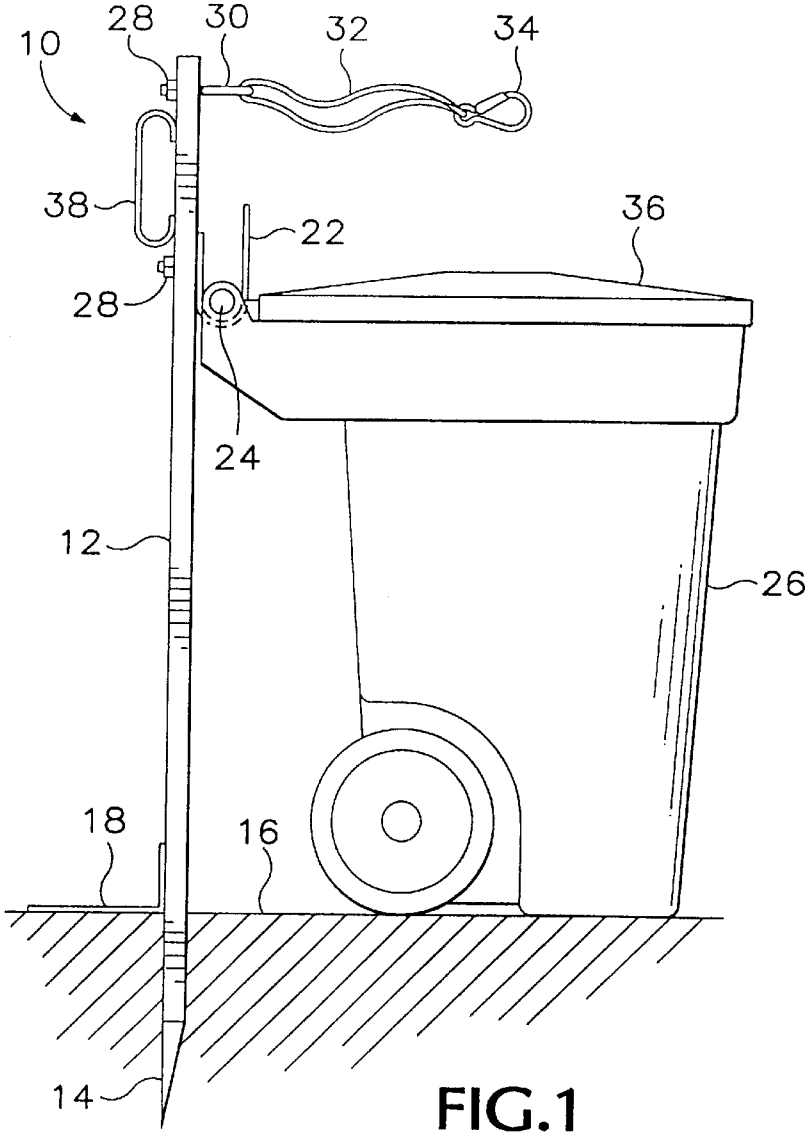
FIG. 1 is a side elevational view of the present invention shown installed in the ground securing a wheel-based refuse container.
Figure 3:
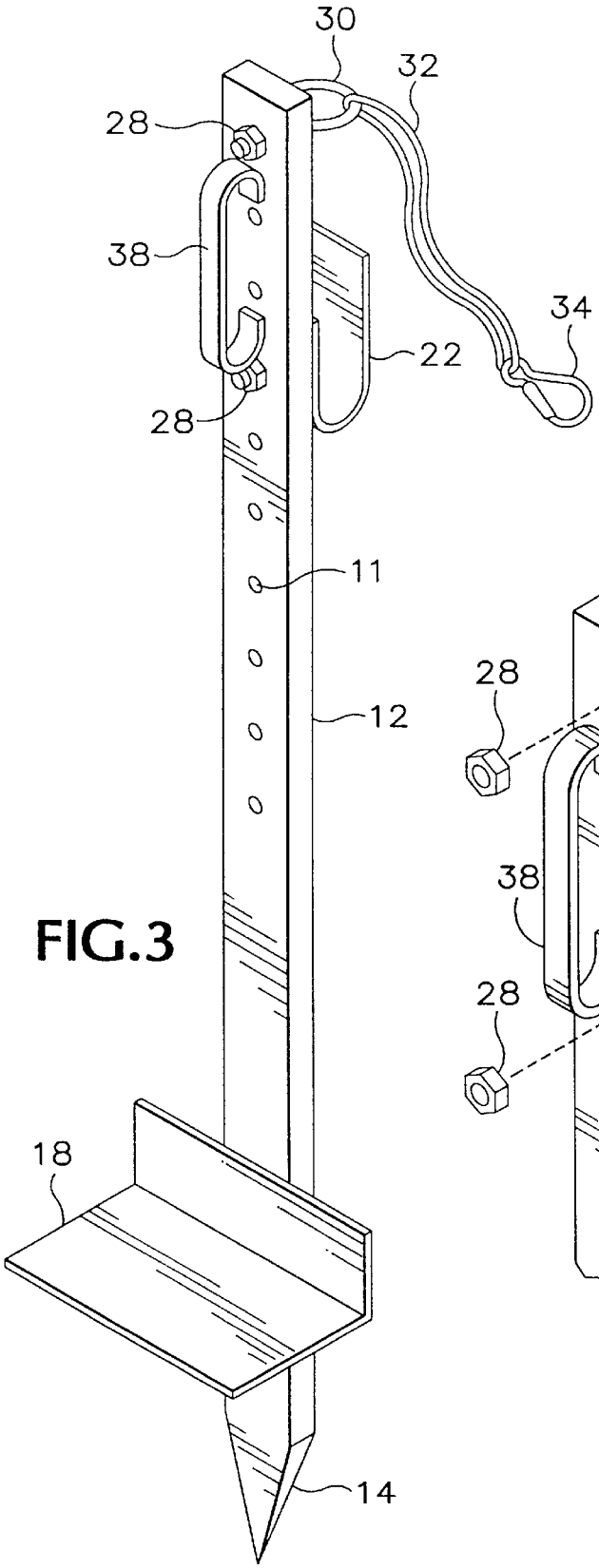
FIG. 3 is a top, oblique isometric, assembled view of the securement apparatus in accordance with the preferred embodiment.
Figure 4:
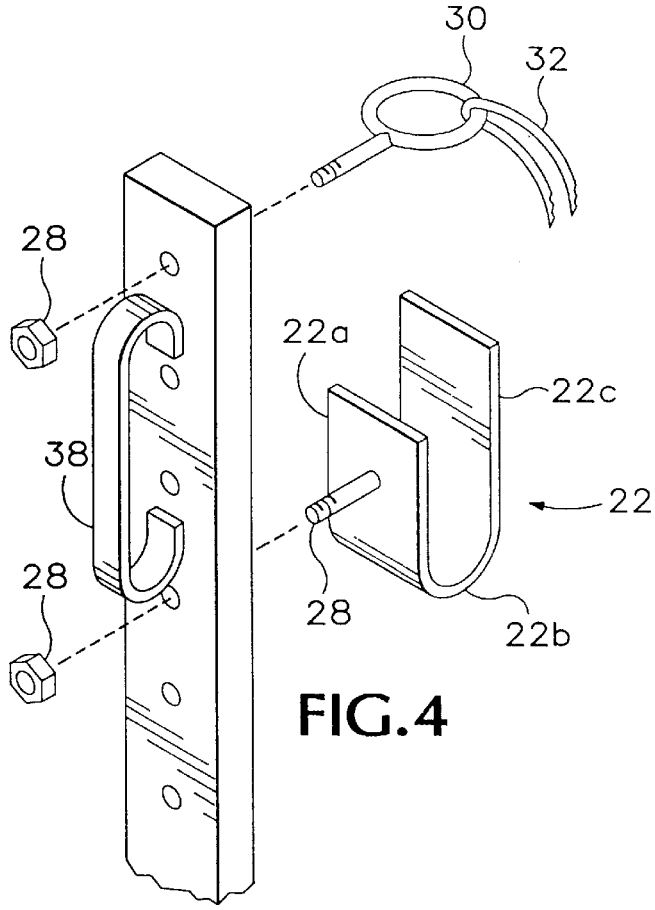
FIG. 4 is a fragmentary, top, oblique isometric exploded view of the elongate stake showing the adjustable hooked bracket in greater detail.

Referring to FIG. 1, the invention is shown generally at 10. An elongate stake 12 is formed of aluminum, steel molded plastic, or other suitable material that will provide sufficient strength to laterally secure the container and its contents. One or more transverse through holes, such as hole 11 shown in FIGS. 3 and 4, are formed in the stake, preferably aligned in a regular array along the stake's long axis, and will be discussed later. Preferably, stake 12 includes a tapered end 14 to facilitate penetration of a support surface 16, such as the ground, by the stake, although the stake without a tapered end can be driven into support surface 16.

Additionally, a support surface penetration stop member 18 is preferably mounted to stake 12 to provide a predefined depth of penetration of support surface 16 by the stake, to promote lateral stability of the apparatus in gusting winds or repetitive attacks by animals and to provide a foot step member dimensioned to be stepped on by a person's foot to facilitate penetration of the support surface by the stake. Surface penetration stop member is wider and longer than the thickness and width respectively of the stake and may be made of, for example, 3"×6" angle iron or any other suitable material. In other embodiments of the invention, the foot step member may be separate from, e.g.; located above, surface penetration stop member 18 or the invented apparatus may be driven into support surface 16 without the benefit of either.

A hooked bracket 22, in the preferred embodiment, is elevationally adjustably mounted to stake 12 by at least one fastener 28, such as a nut and bolt, a cotter pin, or other suitable means, extending through the holes, such as hole 11, formed in the stake. FIG. 4 shows bracket 22 having two projecting or elongate segments 22*a*, 22*c* one of which is adapted by at least one hole to be fastened to stake 12 by fastener 28, and a niche or trough segment 22*b*. Bracket 22 may be any shape such as U-, V-, or J-shaped. Bracket 22 may be elevationally adjusted so that, when stake 12 is vertically penetrating the support surface, a handle 24 of a refuse container 26 is releasably captured therein as shown in FIG. 1.

Figure 2:
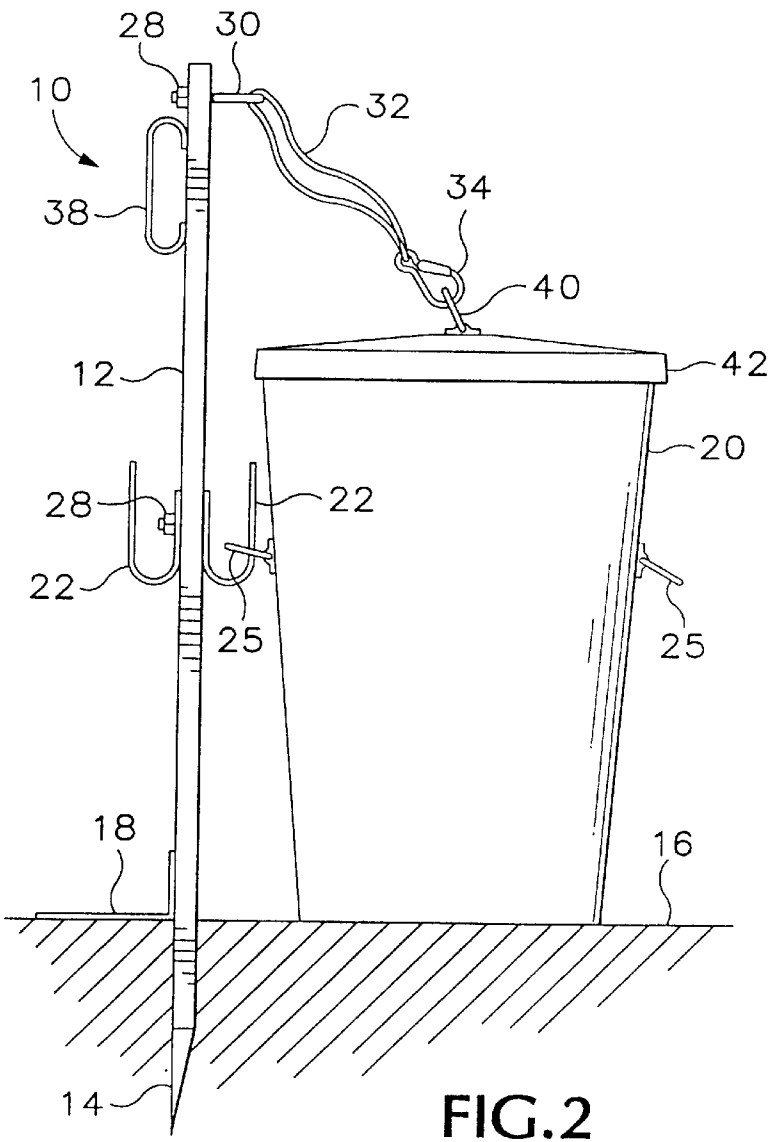
FIG. 2 is a side elevational view of the present invention shown installed in the ground securing a conventional circular refuse container.

In the preferred embodiment, stake 12 includes a looped fastener 30, such as an eye- or U-bolt, preferably attached by at least one fastener 28, such as a threaded post or bolt and nut, a cotter pin, or other suitable means, extending through the holes, such as hole 11, formed in the stake shown in FIGS. 3 and 4, so that a lid 36 may be removably attached to apparatus 10 by a tether means 32 such as a steel-braid, hemp or plastic rope, and a fastener 34, such as a clip, at the end thereof as best shown in FIGS. 1 and 2. Stake 12 also preferably includes a handgrip 38 for ease of portability of the apparatus. Looped fastener 30 and handgrip 38 may be permanently mounted, adjustably mounted, or integrally formed as when the stake is made of molded plastic, all within the spirit and scope of the invention.

In FIG. 1, apparatus 10 is depicted in use with a wheel-based refuse container 26 whereby bracket 22 is mounted to stake 12 so that, when the container is simply moved into place with the handle next to the apparatus, tipped forward and allowed to fall back, handle 24 of the container is captured by bracket 22. The container is released by tipping the container forward so that handle 24 clears bracket 22 and then container 26 may be pivoted away from apparatus 10. When apparatus 10 is used with a wheel-based container, lid 36 may be secured by looping an elongate version of steel-braided rope 32 under the container and over the lid and clipping fastener 34 onto the looped fastener or the bracket. If the user does not want apparatus 10 to remain at the site of use, the lightweight, e.g. as little as approximately 2 to 5 pounds (or less), apparatus may be easily removed and carried in one hand by handgrip 38.

In FIG. 2, apparatus is depicted securing a conventional, circular refuse container 20. Bracket 22 is mounted to stake 12 so that handle 25 is captured thereby. The container is simply tipped to capture and release the handle. Apparatus 10 may be used interchangeably or simultaneously with circular and wheel-based containers of FIGS. 1 and 2 by having two brackets mounted on the same side or opposing sides of stake 12 at heights suitable for the handles of the respective containers. Typically, the circular refuse container has a lid 42 with a handle 40 to which fastener 34 may be clipped to secure the lid. Alternatively, if looped fastener 30 is located lower on stake 12, an elongate version of rope 32 may secure lid 42 by threading it through handles 25 and 40 and clipping fastener 34 to opposing handle 25. It will also be appreciated that, with either the container shown in FIG. 1 or that shown in FIG. 2, two looped fasteners such as looped fastener 30 may be provided—or one double-ended looped fastener may be provided—at any suitable elevation on stake 12 such that two containers' lids may be secured by one or more ropes such as rope 32.

In another embodiment of the invention, when refuse containers are standardized according to height of handles, bracket 22 may be fixedly mounted to stake 12 or integrally molded with stake 12. Also, stake 12 may be wider to accommodate a pair of brackets 22 mounted or integrated at a predefined distance apart and at the same height from the support surface in order to releasably capture both ends of handle 24. Also within the scope of this invention, stake 12 may be made of any shape, e.g. cylindrical, may be hollow or solid, and may be of metal, plastic or any suitable material that provides sufficient rigidity and durability to laterally secure a container and its contents. Nevertheless, the preferred embodiment provides great versatility of securement with various sized and shaped containers, and yet is lightweight, portable, easy to use, and inexpensive to manufacture.

Accordingly, while a preferred embodiment of the invention has been described herein, and preferred methods of use associated therewith, it is appreciated that modifications are possible that are within the scope of the invention. Those variations and modifications are intended to be covered by the following claims.

I claim:

1. A secure containment apparatus in cooperation with a ground-level support surface comprising:

a wheel-based container resting on the support surface at ground level with one or more wheels in rolling contact therewith, said container having a containment lid and a handle for tipping said container to one side and for rolling said container along the support surface with only said one or more wheels in contact therewith, said one or more wheels being located on said same one side of said container as is said handle such that said container is preferentially biased toward tipping by rotation of said one or more wheels;

an elongate stake configured to be partially embedded in the support surface, wherein one end of said stake is tapered generally to a point for penetrating the support surface;

a generally U-shaped bracket with one upwardly extending first elongated segment configured to be coupled to said stake, a lower niche segment of said U-shaped bracket configured to releasably capture said handle of said container and an upwardly extending second elongated segment to retain said handle within the niche segment whereby, with the U-shaped bracket coupled to said stake and the handle of said container captured by said U-shaped bracket, said container is secured and rests on the support surface at ground level; and a support surface penetration stop member joined near said tapered end of said stake at a distance from said tapered end to provide vertical support surface penetration, to a predefined extent, by said stake, wherein said support surface penetration stop member is configured to form an L-shaped with said stake and extend radially in a plane generally normal to a long axis of said stake further to facilitate support surface penetration by providing a step-on surface for stepping on to urge said stake into the support surface;

whereby the bottom of said wheel-based container is supported on the ground level support surface; wherein the lower portion of said wheel-based container is free to move relative to the elongated stake and wherein said U-shaped bracket cooperates with the wheel-based container handle to restrict lateral and tipping movement of said wheel-based container.

2. The apparatus of claim 1, which further comprises a handgrip coupled to said stake for portability of said apparatus and for stabilizing said stake while said stake is being urged into the support surface.

3. The apparatus of claim 2, which further comprises a tether coupled to an end of said stake opposite said tapered end, said tether being removably attachable to said lid.

* * * * *